US011014144B2

(12) United States Patent
Klaus et al.

(10) Patent No.: US 11,014,144 B2
(45) Date of Patent: May 25, 2021

(54) CASTING MOULD FOR CASTING COMPLEX-SHAPED CASTINGS AND USE OF SUCH A CASTING MOULD

(71) Applicant: Nemak, S.A.B. de C.V., Garcia (MX)

(72) Inventors: Gerald Klaus, Saarbruecken (DE); Dirk Schnubel, Saarbruecken (DE); Carmen Schäfer, Puettlingen (DE); Christoph Tomczok, Merchweiler (DE); Tim Schneider, Marpingen (DE); Steffen Spiess, Saarbruecken (DE); Paulo Rossi, Saarbruecken (DE)

(73) Assignee: Nemak, S.A.B. de C.V., Garcia (MX)

( * ) Notice: Subject to any disclaimer, the term of this patent is extended or adjusted under 35 U.S.C. 154(b) by 100 days.

(21) Appl. No.: 16/473,828

(22) PCT Filed: Jan. 17, 2018

(86) PCT No.: PCT/IB2018/000021
§ 371 (c)(1),
(2) Date: Jun. 26, 2019

(87) PCT Pub. No.: WO2018/134672
PCT Pub. Date: Jul. 26, 2018

(65) Prior Publication Data

US 2019/0337047 A1 Nov. 7, 2019

(30) Foreign Application Priority Data

Jan. 17, 2017 (DE) ..... 102017100805.5

(51) Int. Cl.
*B22C 9/08* (2006.01)
*B22C 9/02* (2006.01)
*B22C 9/22* (2006.01)

(52) U.S. Cl.
CPC ..... *B22C 9/082* (2013.01); *B22C 9/02* (2013.01); *B22C 9/22* (2013.01)

(58) Field of Classification Search
CPC .. B22C 9/02; B22C 9/08; B22C 9/082; B22C 9/086; B22C 9/22; B22D 27/08
(Continued)

(56) References Cited

U.S. PATENT DOCUMENTS 4,741,463 A 5/1988 Muller et al.
5,381,851 A 1/1995 Bilz et al.
(Continued)

FOREIGN PATENT DOCUMENTS

CN 101733363 A 6/2010
CN 205008543 U 2/2016
(Continued)

OTHER PUBLICATIONS

Matsudo, Casting Engineering, Japan Foundry Engineering Society, Jul. 2012, vol. 84, No. 7, 407-4, (Relevant for reasons cited in the JP Office Action).

*Primary Examiner* — Kevin P Kerns
(74) *Attorney, Agent, or Firm* — The Webb Law Firm

(57) ABSTRACT

A casting mould for casting complex-shaped castings from a molten metal. The casting mould has a mould cavity forming the casting and a delivery system that delivers molten metal into the mould cavity. The delivery system includes a sprue, a runner connected to the sprue and a feeder system connected to the runner. The mould cavity is connected to the feeder system or the runner via connections. When seen in the flow direction of the molten metal flowing from the sprue into the runner during the casting operation, the runner has a branch directed away from the sprue along the feeder system and has a directed-back branch adjoining the directed-away branch and guided along
(Continued)

the feeder system in the opposite direction to the directed-away branch. The feeder system is connected to both the directed-away branch and the directed-back branch via two or more gates distributed along the respective branch.

15 Claims, 9 Drawing Sheets

(58) Field of Classification Search
USPC ..... 164/361, 365, 342, 133, 119, 306
See application file for complete search history.

(56) References Cited

U.S. PATENT DOCUMENTS

| | | | |
|---|---|---|---|
| 2002/0000304 | A1 | 1/2002 | Kahn et al. |
| 2012/0012272 | A1 | 1/2012 | Smetan et al. |
| 2015/0122447 | A1 | 5/2015 | Arnold |
| 2015/0352631 | A1 | 12/2015 | Meishner et al. |

FOREIGN PATENT DOCUMENTS

| | | | | | |
|---|---|---|---|---|---|
| DE | 3924742 | A1 | | 1/1991 | |
| DE | 4103802 | A1 | | 1/1992 | |
| DE | 4244789 | A1 | | 12/1994 | |
| EP | 2352608 | B1 | | 9/2013 | |
| JP | 5350394 | A | | 5/1978 | |
| JP | 60-199546 | A | * | 10/1985 | ..... B22C 9/08 |
| JP | 60199546 | A | | 10/1985 | |
| JP | H739994 | A | | 2/1995 | |
| JP | 20021484 | A | | 1/2002 | |
| JP | 200635243 | A | | 2/2006 | |
| JP | 2006334657 | A | | 12/2006 | |
| JP | 2015515926 | A | | 6/2015 | |
| RU | 2010673 | C1 | | 4/1994 | |
| RU | 2205091 | C2 | | 2/2003 | |
| WO | 2014111573 | A1 | | 7/2014 | |

* cited by examiner

CASTING MOULD FOR CASTING COMPLEX-SHAPED CASTINGS AND USE OF SUCH A CASTING MOULD

CROSS-REFERENCE TO RELATED APPLICATIONS

This application is the United States national phase of International Application No. PCT/IB2018/000021 filed Jan. 17, 2018, and claims priority to German Patent Application No. 10 2017 100 805.5 filed Jan. 17, 2017, the disclosures of which are hereby incorporated by reference in their entirety.

BACKGROUND OF THE INVENTION

The invention relates to a casting mould for casting complex-shaped, large-volume castings from a molten metal. Such casting moulds typically include a mould cavity forming the casting and a delivery system for supplying the molten metal, which is to be cast into the casting, into the mould cavity. The delivery system comprises a sprue, a runner connected to the sprue, and a feeder system which is connected to the runner, the casting mould cavity being connected to the feeder system or the runner via connections.

Furthermore, the invention relates to a practical use of such a casting mould.

On the one hand, the feeder system is used during the casting of castings with casting moulds of the type in question for control of the solidification direction of the poured melt, optimally directed towards the feeder. On the other hand, the volume of melt held in the feeder system compensates for the reduction in the specific volume of the poured melt during the liquid/solid phase transition. The feeder system constitutes an additionally attached melt reservoir, from which melt can flow into the casting during cooling.

A particular challenge is the casting of modern cylinder crankcases and comparable filigree castings made from light metal alloys, which can develop good mechanical properties or a high thermal load capacity. Such light metal alloys include, for example, hardenable AlCu alloys.

In practice, the high property potential of such light metal alloys is offset by problems in the reliable casting production of high-quality castings on an industrial scale. For example, it proves difficult to produce complex-shaped castings from AlCu alloys that are free of blowholes and hot cracks. It has been found that the quality of the casting obtained depends crucially on the uniformity of the filling of the mould cavity and the homogeneity of the temperature distribution in the melt.

Mass accumulations are to be avoided in alloys with a non-shell-forming, paste-like and/or spongy solidification morphology, since shrinkages develop and the backfeed is made more difficult by the backflow of the melt within the solidifying casting itself.

From the prior art, a large number of proposals for casting moulds intended to meet these requirements is known.

DE 42 44 789 A1 discloses a casting mould for casting a cylinder crankcase for an internal combustion engine, in which two separate feed hoppers are provided, via which the melt is poured into the casting mould. From the feed hoppers, the melt flows respectively via a runner into the mould cavity delimited by the casting mould. The runners are guided through a crankcase block core. Casting channels branch off from the runners and lead to lower casting contours of the casting mould. The casting channels are respectively aligned so that their mouths lie on a horizontal plane.

A low-pressure mould casting method for casting metal castings, such as cylinder heads or engine blocks of internal combustion engines, is known from DE 39 24 742 A1. The complexity of the castings to be cast with this method results from the fact that they have walls that are thinner in at least one region than in another region. In the known method, liquid metal is forced out of a melt container through a riser pipe into the mould by means of gas pressure. The mould is arranged so that in the mould the thicker walls of the casting are located on top and thus far away from the sprue via which the metal passes into the cavity of the casting mould which forms the component. At the same time, the liquid metal on or near the region of the mould located close to the sprue is directed into the sections forming the thinner wall of the casting mould. The liquid metal can be supplied to the region of the mould located near the sprue at the bottom, via a base runner at a plurality of sprue points, and can be introduced into the sections of the mould cavity forming the thinner wall of the casting.

Lastly, WO 2014/111573 A1 discloses a method for casting castings, in which a molten metal is poured off via a feeder or separate runners or casting channels into a mould cavity surrounded by a casting mould and forming the casting. The casting mould comprises mould parts which determine the shape of the casting to be cast. The melt is guided via at least two connections, at least one of which is formed as an additional channel leading through one of the mould parts and independent of the contour of the casting which is to be cast, into at least two sections of the mould cavity, which are assigned to different planes of the casting which is to be cast.

For the casting of castings of the type considered here, casting moulds which are completely or partially formed as a core stack are particularly suitable. In such a core stack, the casting mould is composed of a larger number of cores which determine the inner and outer contour of the casting to be produced. The casting cores are usually made of a moulding material or an easily destructible material as "lost cores", which are destroyed during demoulding of the casting. However, hybrid forms of core stacks are also known, in which, for example, the mould parts defining the outer contour are designed as reusable permanent mould parts, while the recesses, cavities, channels, lines etc. to be formed inside the casting are formed by lost cores.

Core stack casting moulds of the type described above are mainly used in gravity casting or low-pressure casting methods; whereby these methods may also include rotating the casting mould after it has been filled with the melt, in order to achieve an optimised solidification process and, consequently, optimal structural characteristics of the casting.

Against the background of the prior art explained above, the object of the invention was to provide a casting mould which reliably allows the production of highly complex-shaped castings, even from alloys which can be difficult to cast and whose casting results can be of an unreliable quality using conventional methods.

In addition, a particularly advantageous use of such a casting mould is to be specified.

With regard to the casting mould, the invention has achieved this object.

The casting mould designed according to the invention is particularly suitable for use in casting a cylinder crankcase for an internal combustion engine from a light metal melt, in particular an AlCu melt.

SUMMARY OF THE INVENTION

A casting mould according to the invention for casting complex-shaped, large-volume castings from a molten metal has a mould cavity forming the casting and a delivery system for delivering the molten metal which is to be cast into the casting, into the mould cavity, the delivery system comprising a sprue, a runner connected to the sprue, and a feeder system connected to the runner, the casting mould cavity being connected to the feeder system or the casting via connections.

According to the invention, when seen in the flow direction of the molten metal flowing from the sprue into the runner during the casting operation, the runner, having a branch directed away from the sprue along the feeder system and having a directed-back branch adjoining the directed-away branch, is guided along the feeder system in the opposite direction to the directed-away branch, whereby the feeder system being connected to both the directed-away branch and the directed-back branch via two or more gates distributed along the respective branch.

With the design according to the invention of a casting mould, it is possible to uniform the temperature of the melt provided in the feeder system and guided into the casting mould cavity in such a way that an equally uniform temperature distribution is established in the casting. Even with difficult-to-cast molten metals, especially in the case of light metal melts that are difficult to cast, such as AlCu melts, this results in a uniform solidification process after the casting mould has been filled, during which a uniform backfeed from the feeder system is ensured. In this way, local temperature differences and a concomitant non-uniform solidification in the various planes of the casting, bringing the risk of blowhole formation, are avoided. Instead, in the melt filled into a casting mould according to the invention, a solidification front reliably forms which progresses continuously from the point farthest from the feeder system towards the feeder system.

It should be understood that the terms "uniform temperature distribution", "average temperature", "homogenisation of the temperature distribution", "equal temperatures", "uniform temperature" and the like used herein are to be understood in a technical sense, i.e. they can be taken in the context of the technical possibilities having the usual tolerances expected by the person skilled in the art.

The homogenisation of the temperature of the melt flow supplied to the mould cavity is achieved according to the invention in that the melt flow fed in via the sprue is first led along the feeder system in a "directed-away branch" leading away from the sprue, thereby already running into the feeder system via the gates provided along the directed-away branch and then led again towards the sprue in the "directed-back branch" running opposite to the branch directed away from the sprue. However, there is no direct connection between the sprue and the directed-back branch. Rather, only melt from the directed-away branch of the runner runs in its directed-back branch.

The temperature of the melt flowing through the runner as it is poured into the casting mould decreases with increasing distance from the sprue. Accordingly, in a casting mould according to the invention, maximally hot melt flows into the feeder system via the gate of the directed-away branch closest to the sprue, whereas the melt, which runs into the feeder system via the last gate of the directed-back branch in the direction of flow, said gate being furthest removed from the sprue, is maximally cooled. There is therefore a maximum difference in temperature between the melt entering the feeder system via the first gate of the directed-away branch and the last gate of the directed-back gate. By supplying the maximally hot and the maximally cooled melt to the same region of the casting mould, the melt flows of different temperatures mix, and a mix temperature is obtained in the melt contained in this region, which temperature, for example, corresponds to the average temperature of the maximally hot and maximally cooled melt flows flowing into this region given corresponding alignment of the melt volume flows entering into the respective region.

Between the melt which enters into the feeder system through the last gate of the directed-away branch provided in the flow direction at the end of the directed-away branch and is cooled via the passage along the feeder system, and the melt which passes into the feeder system through the first gate of the directed-back branch and is cooled only to a small extent over a comparatively short stretch between the last gate of the directed-away branch and the first gate of the directed-back branch, there is only a correspondingly small temperature difference. Since these melt flows, between which there is a comparatively small temperature difference, are also supplied to the same region of the feeder system, a mix temperature is also present there. This can in turn be controlled by a suitable adjustment of the melt volume flows entering via the gates into the feeder system, so that the mix temperature in the respective region is equal to the mix temperature which is obtained by mixing the maximally hot and the maximally cooled melt in the region of the feeder system adjacent to the sprue.

The same applies to the melt flows, which are routed into the feeder system via those optionally present further gates which are provided along the directed-away branch and the directed-back branch of the runner between the gates provided at the end and at the beginning of the directed-away branch and directed-back branch, when seen in the flow direction of the melt.

As a result, a homogeneous temperature distribution over the entire volume of the feeder system is thus achieved by the design of the runner provided in a casting mould according to the invention and the runner's particular connection to the feeder system. Along with this, the melt passing through the feeder system into the mould cavity also has a uniform temperature distribution, whereby even with a filigree shaping of the design elements to be formed on the casting, such as thin walls and fine webs or ribs, not only is an optimal mould filling achieved, but also a uniform solidification of the melt. Consequently, with the invention it is also possible to cast components whose casting is difficult to control, such as cylinder crankcases for internal combustion engines, even from metal melts which are known for their poor mould filling and feeding capacity, but which can develop good mechanical or thermal properties.

As mentioned, the mix temperature in the feeder system can be set by adjusting the melt volume flows entering the individual regions of the feeder system via the gates provided there. For this purpose, the position on the respective branch of the runner, the number, or the geometry, in particular the diameter, of the gates can be adjusted so that the intended mix temperature in the feeder system is based on the proportions of the melt flows at different temperatures entering the feeder system to the total melt volume contained in the feeder system.

As a result of the arrangement of the gates which are respectively assigned to the directed-away branch and the directed-back branch, the mixing of the melt entering into the feeder system via the gates, and, consequently, the equalisation of the temperature of the melt contained in the feeder system can be directly influenced.

In this case, the design according to the invention of a casting mould proves to be advantageous in all casting tasks in which a particularly homogeneous temperature distribution in the melt to be cast and a uniform supply of the melt into the casting mould cavity forming the casting are important for the casting success. Thus, the invention can be used for castings with an elongated, block-like basic shape, such as engine blocks, as well as for castings which have a basic shape that is cylindrical and characterised by an ellipsoidal or circular cross-section.

With regard to an optimised homogeneity of the temperature distribution, it has proved to be advantageous if one of the gates via which the directed-back branch is connected to the feeder system is arranged opposite to each gate via which the directed-away branch of the runner is connected to the feeder system. This is advantageous in particular in the case of a feeder system whose length is appreciably greater than its width, that is to say, for example, a feeder system which has a rectangular basic shape in plan view.

If the number of gates assigned to the directed-away branch is equal to the number of gates assigned to the directed-back branch, this likewise contributes to equalising the temperature distribution of the melt contained in the feeder system during the casting operation.

The latter applies in particular if the size of the gates assigned to the directed-away branch is the same as the size of the gates assigned to the directed-back branch, if the gates are dimensioned such that volume flows of the same size enter the feeder system via the gates of the branches of the runner assigned to one another.

Depending on the manner of connection of the feeder system to the mould cavity or the melt volume required for backfeeding the mould cavity during the solidification of the melt in the feeder system, it may be expedient to provide a single sufficiently large feeder chamber in the feeder system which is connected in the manner according to the invention via gates to the directed-away branch and the directed-back branch of the runner. The feeder chamber then serves as a mixing region for the melt passing into the feeder chamber via the directed-away and directed-back branches, thereby contributing to the homogenisation of the melt entering the mould cavity. In addition, such a feeder chamber can assume a feeding function by backfeeding melt into the mould cavity of the casting mould.

If the mixing and the concomitant equalisation of the temperature distribution of the melt contained in the feeder system is to be further optimised, it may be expedient to provide two or more feeder chambers in the feeder system, each of which is connected via at least one gate to both the directed-away branch and the directed-back branch of the runner. In the case of two or more feeder chambers, the individual chambers each respectively contain only a partial volume of the total melt volume required for backfeeding the mould cavity. Due to the correspondingly lower volume of the individual feeder chambers, there is a particularly intensive mixing of the melt flows at different temperatures entering into the feeder chambers via the branches of the runner. In this way, it can be ensured with comparatively little effort that the melt volumes present in the respective melting chamber as a whole have the desired mix temperature, and the formation of local temperature differences is avoided. In this regard, it proves to be particularly advantageous if the volumes contained by the feeder chambers are the same.

In order to ensure, in a feeder system with two or more feeder chambers, that the feeder volumes contained in the individual chambers assume a common mix temperature, the feeder chambers can be connected to one another via additionally provided gates connecting the feeder chambers directly. These additional gates result in the exchange of the melt volumes contained in the feeder chambers and, as a result, compensate for the possibly different temperatures of the melt portions contained in the chambers.

A variant of the invention suitable in particular for casting cylinder crankcases for internal combustion engines with cylinder openings arranged in a row is characterised in that the feeder system comprises at least one, in particular at least two adjacently arranged feeder chambers, and either the directed-away branch is arranged in the intermediate space between the feeder chambers and one directed-back branch branching from the directed-away branch runs along the outer side of each of the feeder chambers with respect to the intermediate space or the directed-away branch is divided into two directed-away branches, one of which respectively runs along the outer side of the feeder chambers with respect to the intermediate space between the feeder chambers, whereas at least one directed-back branch connected to the directed-away branches runs in the intermediate space between the feeder chambers. The uniform division of the melt into the feeder chambers can be assisted by the fact that the runner is branched into two outgoing branches in the immediate connection to the sprue, to which branches one returning branch is respectively connected.

It proves to be particularly advantageous with regard to the distribution of the melt to the branches of the runner of a casting mould according to the invention if the branches of the runner are arranged together in a plane. This plane is optimally oriented horizontally during the casting operation, so that a slope and concomitantly different flow velocities are avoided in the branches of the runner.

In the case of such a common plane for the branches of the runner, it has proven to be advantageous if the gates of the incoming and returning branch respectively have their own level, so that the melt is layered during convergence and does not collide.

A further embodiment of the invention which is particularly important in practice consists in the connection leading from the feeder system or from the runner to the mould cavity being guided exclusively outside the volume of the casting mould occupied by the mould cavity. By guiding the melt exclusively into the mould cavity via connections formed externally in the region of the casting cavity surrounding the mould cavity, the uniformity of the temperature distribution of the melt flowing into the mould cavity in the casting operation and the uniformity of mould filling are optimised in a casting mould according to the invention.

By the connection being made exclusively outside of the mould cavity, temperature differences in the melt introduced into the mould cavity are avoided in the casting operation. These may occur when melt is also guided into the mould cavity via inner cores heated by the melt flowing into the mould cavity, which inner cores form recesses, cavities, channels and the like in the casting. Due to the heating of the inner cores, the melt flowing through them would cool less than the melt supplied via the outer connections. Since the melt is supplied to the mould cavity only via outer connections, it is thus ensured that the melt cools evenly on its way from the feeder system or from the runner into the mould cavity and thus enters the mould cavity at a uniform temperature.

In this regard, it has proven to be particularly advantageous if, in the event that the feeder system is connected via a plurality of connections to the mould cavity, the inflow openings of the connections assigned to the feeder system are arranged together in a plane. In this way, the melt is discharged from the feeder system at the same level, at which there is a uniform temperature of the melt contained in the chambers, of which there may be a plurality. This also contributes to the fact that the melt entering the mould cavity has a uniform temperature in the technical sense.

The casting mould according to the invention is suitable for gravity casting or low pressure casting. In particular, with casting moulds according to the invention, castings can be produced in tilt-casting or rotational casting processes in which the casting mould is moved from a filling position into a solidification position after or during filling. An explanation summarising these methods can be found in EP 2 352 608 B1 and the prior art cited therein.

In order to be able to form the filigree design features of casting parts to be cast using casting moulds according to the invention, the casting mould according to the invention can be composed as a core stack from a plurality of cores, of which certain cores form the outer shape and other cores form recesses, cavities, channels and the like in the casting to be produced. In this case, the cores of the core stack as a whole can be designed as lost cores, which are destroyed in the demoulding of the casting, or some of the cores can be formed as permanent mould parts that can be used repeatedly.

Thus, in a case which is especially advantageous in practice, in which the connection of the feeder system to the mould cavity is realised exclusively via connections that are outside of the mould cavity, it can be particularly expedient, for example in a casting mould according to the invention, for an outer shell to be designed as a permanent mould part, on which outer shell at least the casting cores surrounding the connections, at least in sections, are held. This proves to be advantageous in particular when the casting cores surrounding the connections, at least in sections, are formed as lost casting cores.

The invention thus makes it possible to present a cylinder crankcase in the core stack process with a delivery system in which the melt is divided into two runner branches, so that the feeder system connected thereto and comprising optimally pot-like feeder chambers serves to homogenise the temperature distribution in the feeder system and subsequently in the component formed by the casting mould. In the casting operation, the feeder system is filled by its two or multiple gates to the branches of the runner by melt at different temperatures. By adapting the geometries and the position of the gates, a mixture of the melt in the feeder system is achieved in such a way as to result in a homogeneous temperature distribution overall in the feeder system. The melt, which has a correspondingly homogeneous temperature, is fed to the mould cavity forming the casting.

The casting course made possible by the design according to the invention, in particular in combination with the feeding of the mould cavity, which may optionally be done exclusively from the outside, and the concomitant avoidance of "internal" feeding paths, allows difficult-to-cast light metal melts, such as alloys based on Al—Cu, to be cast free from macroscopic defects despite their generally poor filling and feeding properties. The feeders and outer connections present on the casting after demoulding of the casting can be easily removed with a neutral effect on weight by common machining methods such as drilling, for example. Mass accumulations on the casting, which are provided in the prior art to prevent local premature solidification of the melt, but do not fulfil any other technical purpose, can be avoided in a casting mould according to the invention, as can complex channel guides in the connection of the feeder system to the mould cavity for the purpose of avoiding freezing phenomena.

Of course, even in a casting mould according to the invention, chill moulds may be arranged in the region of the mould cavity, in order to accomplish, in a conventional manner, a locally accelerated solidification there for the purpose of forming a locally particularly pronounced structure. In particular, when the filling and backfeeding of the mould cavity with melt takes place exclusively via outer connections, these chill moulds in the casting operation do not impede the uniform filling process ensured by the design according to the invention.

BRIEF DESCRIPTION OF THE DRAWINGS

The invention will subsequently be explained in more detail with reference to a drawing depicting exemplary embodiments. The figures thereof show schematically and not to scale.

DESCRIPTION OF THE INVENTION

Figure 1:
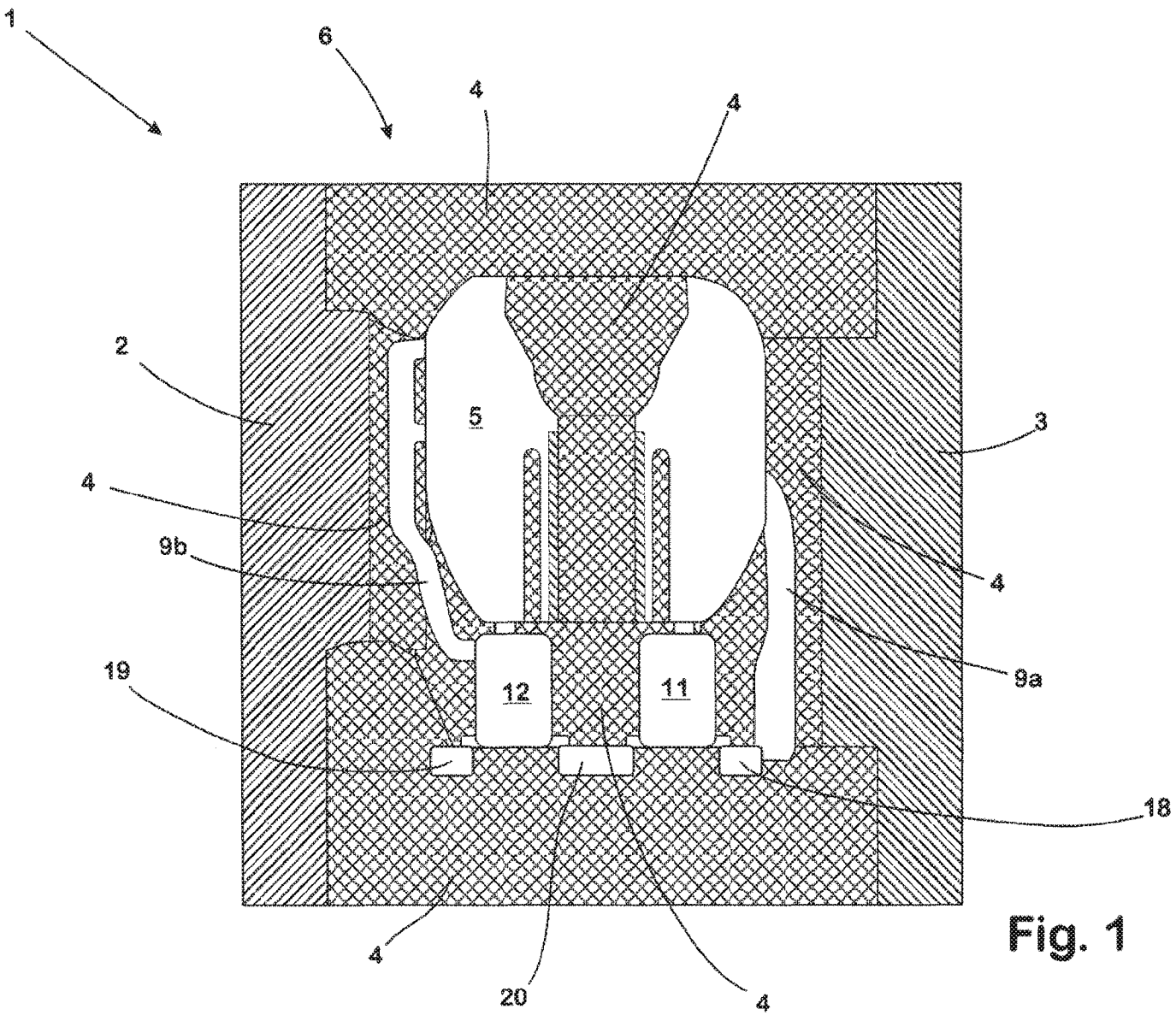
FIG. 1 a casting mould for casting a cylinder crankcase for an internal combustion engine in a cross-section.
Figure 2:
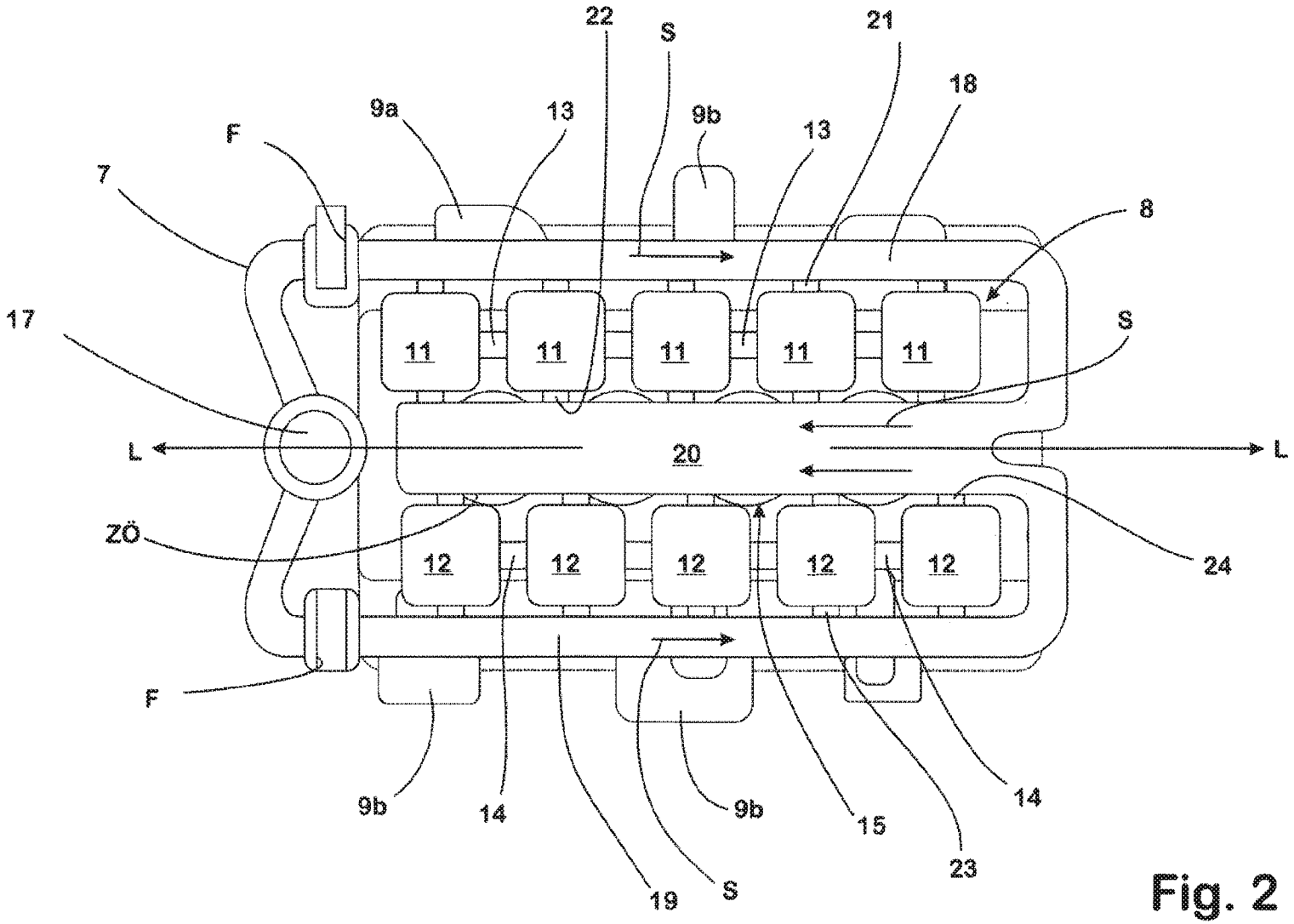
FIG. 2 a cylinder crankcase which has been cast in the casting mould 1 after demoulding in the un-cleaned state, in a view from above.
Figure 4:
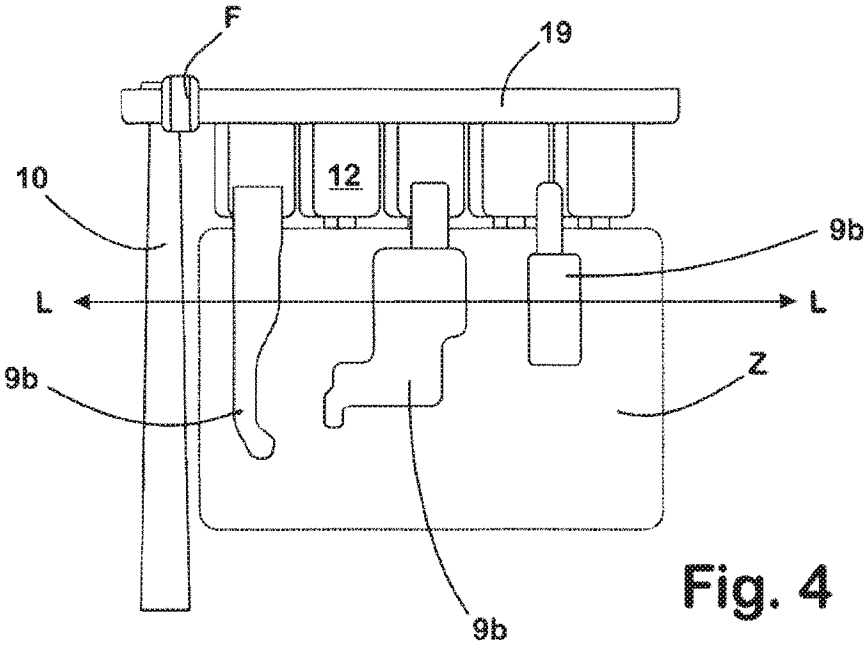
FIG. 4 the cylinder crankcase according to FIGS. 2 and 3 in a side view.
Figure 3:
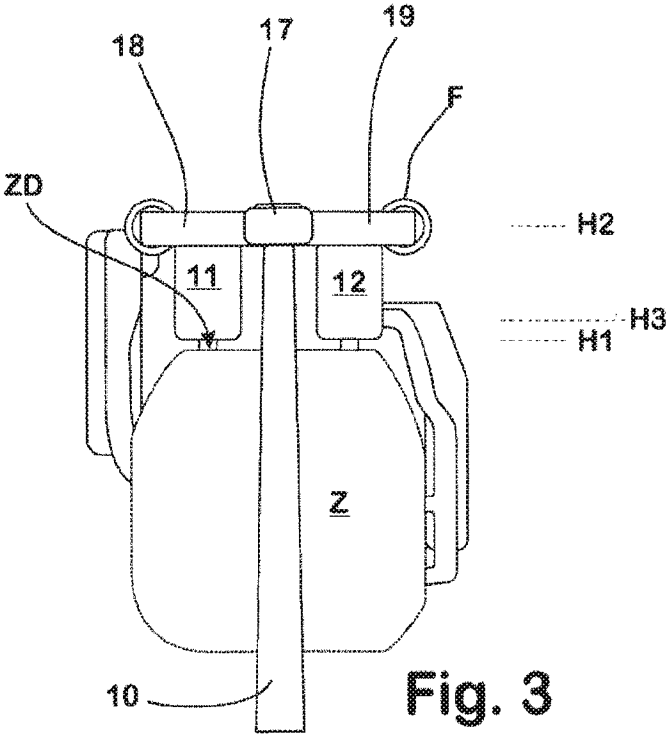
FIG. 3 the cylinder crankcase according to FIG. 2 in a frontal view of its one end face.

The casting mould 1 shown in FIG. 1 is used for casting the cylinder crankcase Z shown in FIGS. 2-4, often also called cylinder blocks, for an internal combustion engine made of an AlCu alloy.

FIG. 1 shows schematically a section transverse to the longitudinal extension of the cylinder crankcase Z.

The casting mould 1 designed as a core stack comprises two outer shells 2,3 formed as permanent mould parts, between which are arranged a larger number of lost casting cores 4 formed in the conventional manner from moulding sand. The outer shells 2, 3 and the casting cores 4 surround a mould cavity 5, which forms the cylinder crankcase Z to be cast with its four cylinder openings ZÖ arranged in a row and the design features usually provided for such internal combustion engine cylinder crankcases.

Furthermore, the casting cores 4 surround a sprue, not visible in FIG. 1, leading downwards perpendicularly from the side 6 of the casting mould 1 arranged at the top in FIG. 1, a runner 7 connected to the sprue, a feeder system 8 connected to the runner 7 and the casting cavity 5, as well as connections 9*a*, 9*b* provided for connecting the mould cavity 5 to the runner 7 or the feeder system 8.

The casting mould 1 is shown in FIG. 1 in the position shown for filling with melt, in which the opening of the sprue faces up and the feeder system 8 is arranged at the bottom of the casting mould 1.

After filling the melt, the casting mould 1 is closed in a conventional manner and is rotated, for example, 180° in a known manner, about a pivot axis aligned parallel to the longitudinal extension of the casting mould 1, until the feeder system 8 is arranged above. In this way, a uniform solidification of the melt filled into the casting mould 1 is favoured, which solidification takes place in the direction of the feeder system 8.

During solidification, not only does the cylinder crankcase Z to be produced form as a solid cast body, but after demoulding, these originally hollow mould elements of the casting mould 1 are formed contiguous with the cylinder crankcase Z as a consequence of the melt solidifying in the sprue 10, in the runner 7, in the feeder system 8 and in the connections 9*a*, 9*b*.

During cleaning following demoulding, the relevant mould elements are separated from the cylinder crankcase Z in a conventional manner, and sent for recycling.

The special features of a casting mould 1 according to the invention can thus be illustrated most simply on the demoulded and not-yet-cleaned cylinder crankcase Z, as shown in FIGS. 2-4.

The feeder system 8 accordingly comprises two rows arranged side by side and extending in the longitudinal direction L of the cylinder crankcase Z, each having five pot-type feeder chambers 11, 12. Adjacent feeder chambers 11, 12 of each row are connected by gates 13, 14. The rows of feeder chambers 11, 12 delimit a gap 15 between them.

The feeder chambers 11, 12 are arranged above the top surface ZD of the cylinder crankcase Z provided for mounting a cylinder head (not shown here) and have identical shapes and volumes. The bases of the feeder chambers 11, 12 are arranged together in a horizontal plane H1, which is aligned parallel to the top surface ZD of the cylinder crankcase Z.

The runner 7 is also arranged in a horizontal plane H2, aligned parallel to the top surface ZD, in which the top of the feeder chambers 11, 12 also ends.

Starting from the head 17 of the sprue 10 shown on the demoulded cylinder crankcase Z as a sprue rod running slightly conical in the direction of the runner 7, the runner 7 is divided into two branches 18, 19, said branches 18, 19 being directed away from the sprue 10, seen in the flow direction S of the melt filled into the casting mould 1 during the casting operation.

The branches 18, 19 directed away from the sprue 10, mirror-symmetrically formed with respect to the longitudinal axis L of the cylinder crankcase Z when viewed in plan view (FIG. 2), first emanate respectively from the sprue head 17 transverse to the longitudinal axis L, in order then to transition in a curve and via a filter F in each case into a section which extends at a small distance along the outer side of the respective row of the feeder chambers 11, 12, said side facing away from the intermediate space 15.

At the end of the respective row of feeder chambers 11, 12, seen in the flow direction S, the directed-away branches 18, 19 transition in a further curve into a section oriented opposite the other directed-away branches 19, 18, which section extends over the width of the respective row of feeder chambers 11, 12.

At the end of this section, as seen in the flow direction S, the directed-away branches 18, 19 of the runner 7 open together in a branch 20 of the runner directed back in the direction of the sprue head 17. This directed-back branch 20 of the runner 7 has a cross-sectional area which corresponds at least approximately to the sum of the cross-sectional areas of the directed-away branches 18, 19. In this way, the directed-back branch 20 can safely receive the melt volumes flowing into it via the directed-away branches 18, 19.

The directed-back branch 20 is arranged centrally in the intermediate space 15 between the rows of feeder chambers 11, 12 and runs towards the sprue 10 opposite to the branches 18, 19 directed away from the sprue 10, viewed in the flow direction S. However, the directed-back branch 20 terminates in front of the sprue head 17, so that in the casting operation, melt enters into the directed-back branch 20 exclusively via the directed-away branches 18, 19.

Each of the feeder chambers 11 arranged at equal intervals along the longitudinal axis L is connected to the directed-away branch 18 via a respective gate 21 and each of the feeder chambers 12 also arranged at equal intervals in the longitudinal direction L is connected to the directed-away branch 19 via a respective gate 22. Similarly, each of the feeder chambers 11 is connected to the directed-back branch 20 via a respective gate 23 and each of the feeder chambers 12 is connected to the directed-back branch 20 via a respective gate 24. The gates 21-24 are also distributed at equal intervals along the longitudinal axis L, wherein the gates 21, 22; 23, 24 respectively assigned to each feeder chamber 11, 12 are positioned opposite to each other and centrally relative to the respective wall of the feeder chambers 11, 12.

The mould cavity 5 is connected via connections 9*a*, 9*b* directly to the runner 7 (connection 9*a*) or the feeder chambers 11, 12 (connections 9*b*). The connections 9*a*, 9*b* are respectively exclusively formed outside the mould cavity 5, so that no melt passes into the mould cavity 5 via casting cores 4 placed in the mould cavity 5. According to the principle of communicating vessels, the melt has a level, and consequently a part of the melt also reaches the mould cavity 5 via the feeder chambers 11, 12. The solidification in the component then takes place very quickly via the thin walls and the feeding is achieved only via the locally large volume in direct proximity to the feed supply. The mouth of the connections 9*b* connected to the feeder chambers 11, 12 is in this case arranged on a common horizontal plane H3, so that in each case melt which has an equal temperature passes from the feeder chambers 11, 12 into the connections 9*b* connected to them. The supply of the melt to the mould cavity 5, however, can extend over a height range or be distributed over several planes.

With regard to the filling or the solidification behaviour of particularly critical regions of the mould cavity 5, it is possible to selectively supply melt through a dedicated connection 9*b* in order to feed the respective problem location directly.

Figure 5:
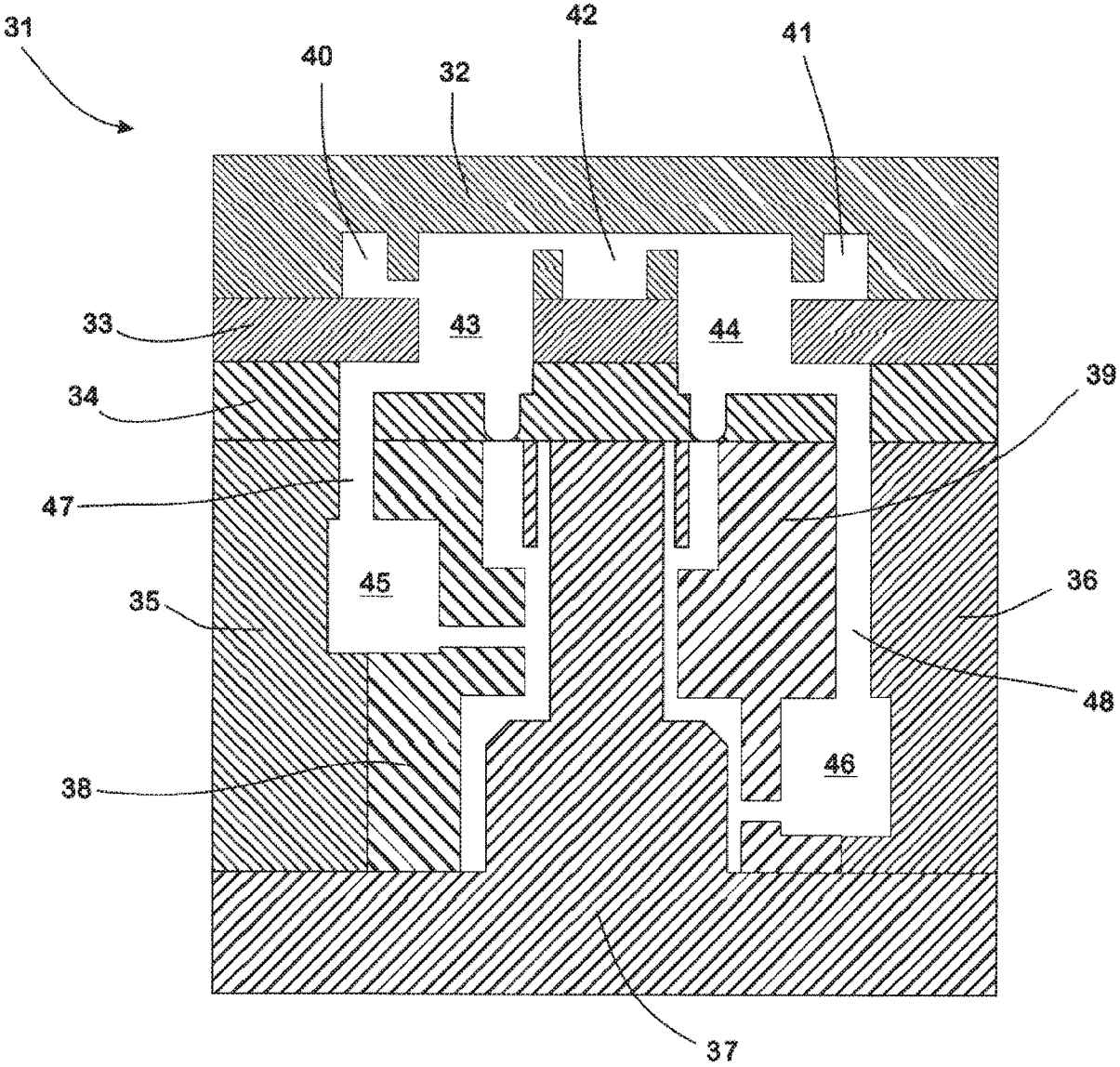
FIG. 5 a further casting mould for casting a cylinder crankcase for an internal combustion engine in a cross-section.

The casting mould 31 shown in FIG. 5, which is constructed entirely as a core stack of lost cores, is also provided for casting a cylinder block for an internal combustion engine. The mould 31 comprises a cover core 32, an outer core 33 bearing the cover core 32, a further outer core 34 bearing the outer core 33, two outer shell cores 35, 36 forming the outer end of the casting mould 31 in the region of the mould cavity of the casting mould 31, on which the outer cores 33, 34 and the cover core 32 are supported, a contouring core 37 forming the contour of the interior of the casting, which contouring core 37 forms the lower end of the casting mould and on which the shell cores 35, 36 are supported, and cores 38, 39 arranged within the space laterally bounded by the shell cores 35, 36, which cores 38, 39 determine the outer contour of the casting.

Branches 40, 41 running on the outside, directed away from the sprue (not shown here), are moulded into the cover core 32, as is a centrally arranged directed-back branch 42 of the runner. In the intermediate space between the directed-away branch 40, 41 respectively arranged outside, and the directed-back branch 42, a feeder pot 43, 44 is respectively moulded into the cover core 32 and the outer cores 33, 34. The feeder pots 43, 44 accordingly sit directly on the top surface of the casting (e.g. sealing surface for an oil sump or cylinder head). The feeder pots 43, 44 thus feed all regions located in direct local proximity to them, such as the cylinder head screw pipes. The directed-away branches 40, 41 are connected via connections, which are arranged close to the outer core 33, to the respectively assigned feeder pot 43, 44, whereas the directed-back branch 42 is connected via connections to the feeder pots 43, 44, which are offset towards the top of the cover core 32.

The shell cores 35, 36 and the respectively assigned cores 38, 39 that determine the outer contour of the casting also additionally delimit respectively external feed volumes 45, 46, which are connected to one of the feeder pots 43, 44 via one inlet 47, 48 in each case. The external feed volumes 45, 46 are filled via the assigned inlet 47, 48, which is always connected to one of the feeder pots 43, 44. The external feed volumes 45, 46 feed everything in their immediate vicinity, e.g. mass accumulations through functional integration.

While the feeder pots 43, 44 are always in the same plane in the casting mould 31 intended for casting cylinder crankcases ZK, the external feed volumes 45, 46 are at different levels.

Figure 6:
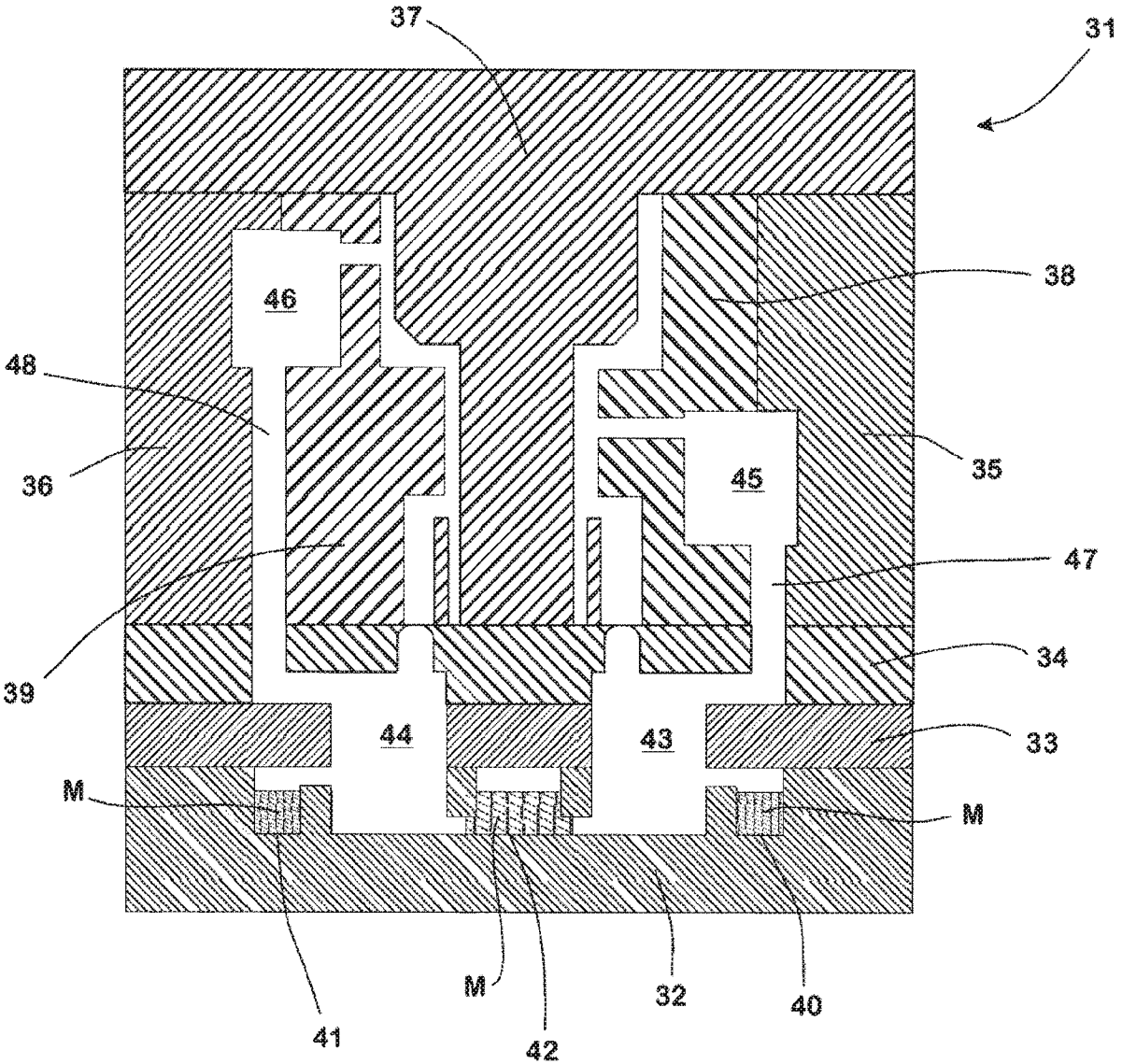
FIGS. 6-9 the casting mould according to FIG. 5 during the filling with melt.

For filling with melt, the casting mould 31 is rotated for example by 180° about a pivot axis transverse to the longitudinal extension of the cylinder crankcase ZK to be cast, so that the cover core 32 is located with the directed-away branches 40, 41 and the directed-back branch 42 at the bottom. Hot melt M is directed into the directed-away branches 40, 41 via the sprue. From the directed-away branches 40, 41, the melt M cooled on the way through the directed-away branches 40, 41 enters into the directed-back branch 42 and into the feeder pots 43, 44 (FIG. 6).

Figure 7:
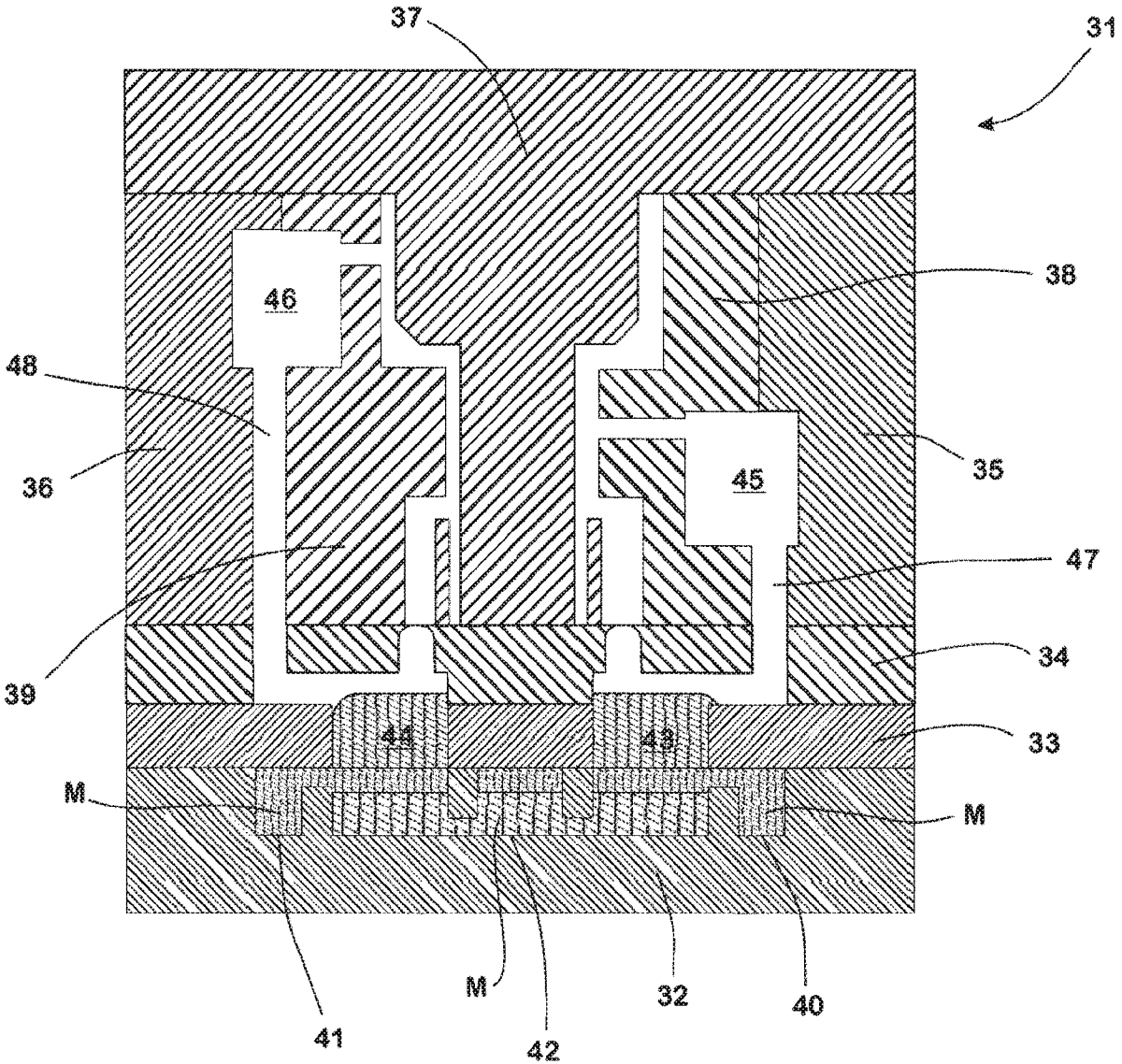

As the directed-away branches 40, 41 become more full, hot melt M also passes via the corresponding connections of the directed-away branches 40, 41 into the feeder pots 43, 44, so that in the feeder pots 43, 44 hot melt M and cooled melt M mix and in the feeder pots 43, 44 melt M is present which has a homogeneously distributed mix temperature (FIG. 7).

Figure 8:
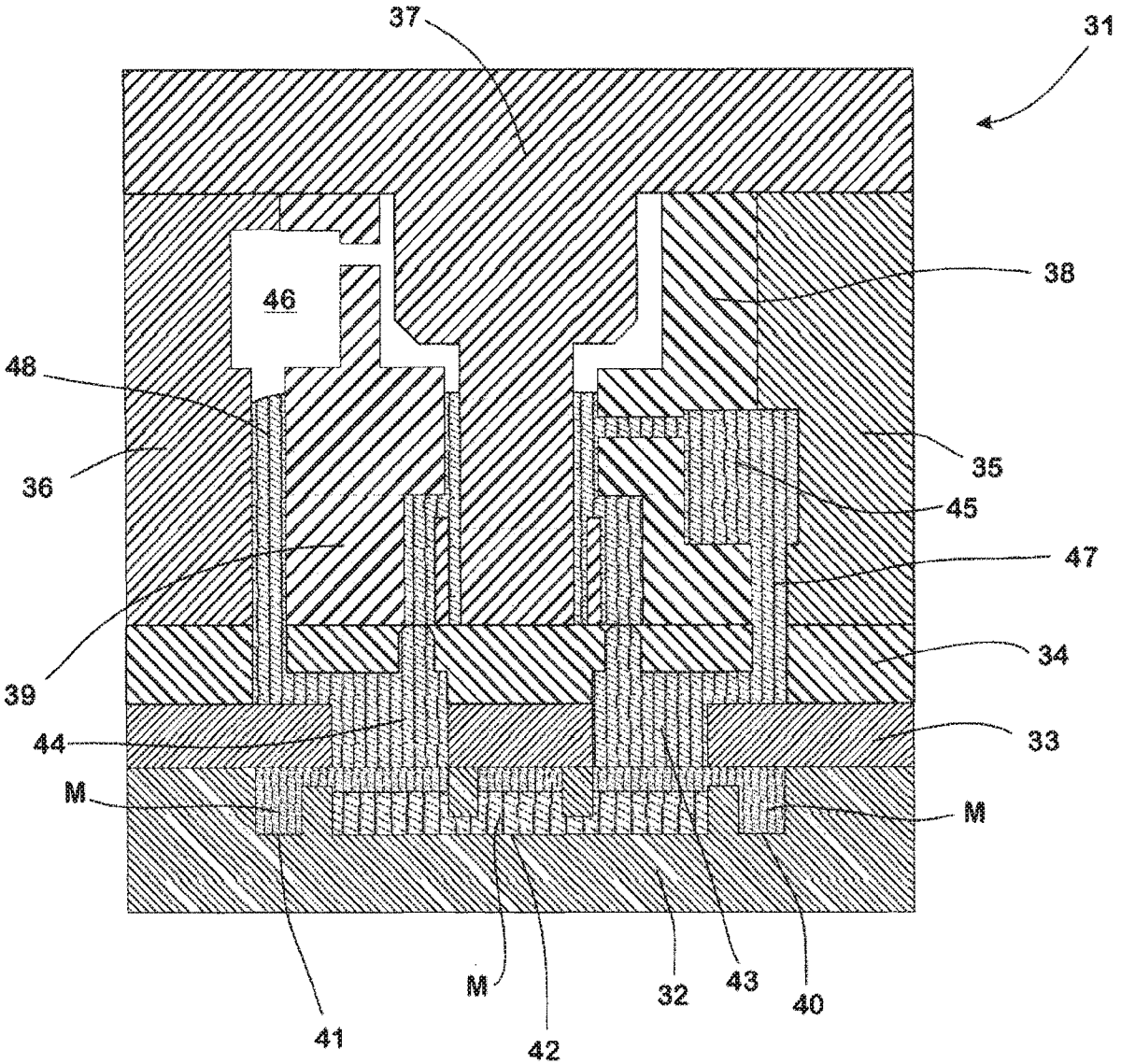

The melt M, which has an appropriate temperature, rises on the one hand via the inlets 47, 48 into the external feed volumes 45, 46 and on the other hand via the gates into the casting mould cavity (FIG. 8), via which gates the feeder pots 43, 44 are connected directly to the casting mould cavity forming the casting.

Figure 9:
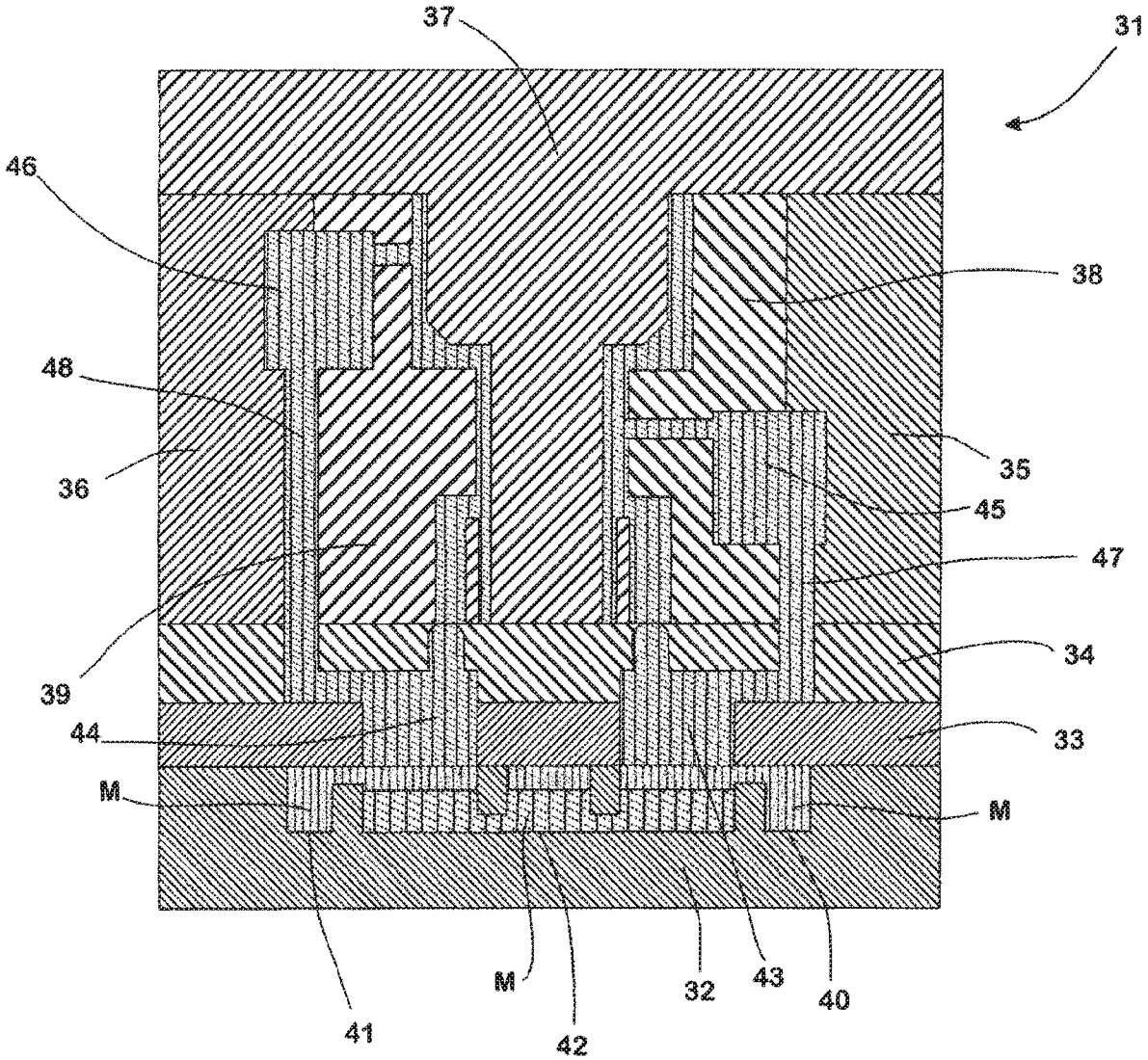
Figure 10:
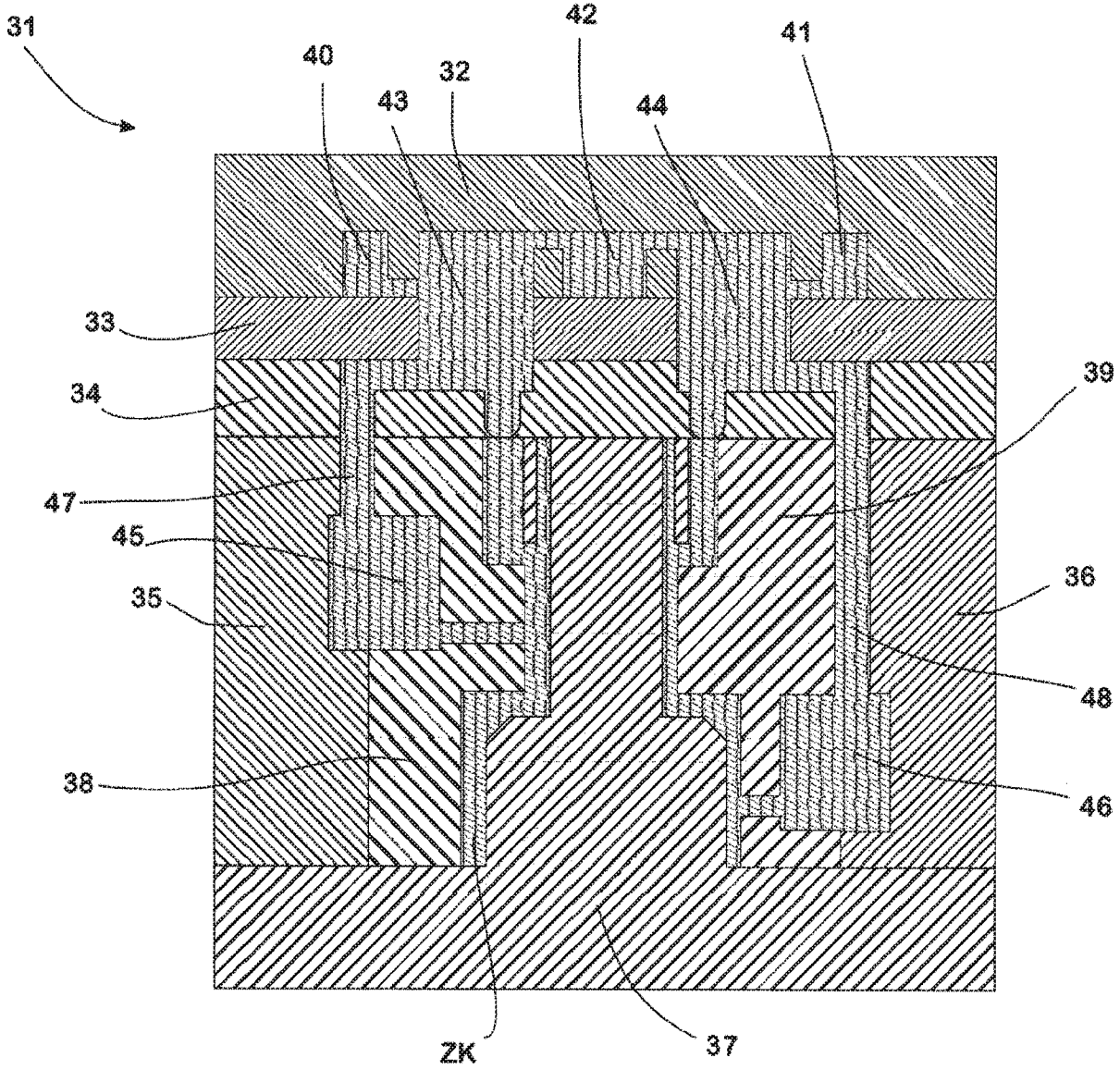
FIG. 10 the casting mould according to FIG. 5 in the post-filling position rotated for solidification.

After complete filling (FIG. 9), the casting mould 31 is closed in a conventional manner and rotated through 180° transverse to its longitudinal extension into the solidification position (FIG. 10).

In the embodiments of a casting mould according to the invention described here, the melt is thus filled via at least one sprue into the casting mould. The melt is then divided into two separate branches directed away from the sprue, which, given a corresponding basic shape of the feeder system, are preferably aligned so that they are parallel at least in sections. The melt, which is divided into the directed-away branches of the runner, is returned to the pot-like feeder chambers via a diversion. In this case, in the region of the diversion, a curve can be provided which leads out of the main plane, in which the runner is mainly located, in order to decelerate the flow velocity of the melt flowing through the respective directed-away branch. The section of the respective branch adjoining the relevant curve then lies again in the main plane of the runner. In connection to the directed-away branches, the melt is led further into at least one central directed-back runner branch. Of course, it is also possible to connect to each directed-away branch of the runner a dedicated directed-back branch also extending in the intermediate space between the rows of feeder chambers.

Early separation of the runner system and delivery of the melt to multiple feeder volumes provided by the feeder chambers results in optimised filling conditions. Thus, the embodiment according to the invention guarantees a rapid, uniform inflow of the molten metal and, consequently, a homogeneous temperature distribution in the feeder system and in the component. For this purpose, the runners are connected to the feeder chambers via gates. The connection of the feeder chambers is chosen so as to enable optimal mixing of the melt entering the chambers. For this purpose, it may for example also be useful not to connect all the feeder chambers directly to the runner as in the exemplary embodiment described here, but to connect individual feeder chambers only to the immediately adjacent feeder chamber, which is then connected to the runner. To support the mixing and the temperature equalisation, the feeder chambers are connected to each other via gates. By varying the gate cross-sections and the feeder chamber volumes, the melt flow and the achieved temperature distribution can be adapted to the respective casting task. Due to the fact that the feeder system is arranged during the solidification above the mould cavity, a solidification is achieved in the direction of the feeder system. That is, the component cools and solidifies starting from the location farthest away from the feeder system, whereas the melt contained in the feeder system and finally filled into the mould remains hot for a longer time. If the casting mould is gravity-cast without rotation, i.e. filled with an overhead feeder system, then the mould cavity forming the casting is filled first and the feeder system is filled last.

Easy removal of the feeder system, the runner, the sprue and the connections can be supported by the fact that the connections are connected to the component contour over a small area. The connection points preferably go onto existing slugs and sit on surfaces which are part of the standard post-processing. The feeder system can be easily removed, e.g. by means of bores, during pre-processing and post-processing of the component obtained (cylinder crankcase Z).

REFERENCE SIGNS

1 casting mould
2, 3 outer shells
4 casting cores
5 mould cavity
6 side of the casting mould 1
7 runner
8 feeder system
9*a*, 9*b* connections
10 sprue
11, 12 feeder chambers
13, 14 gates
15 intermediate space delimited by feeder chambers 11, 12
17 sprue head
18, 19 directed-away branches of the runner 7
30 directed-back branch of the runner 7

21-24 gates
L longitudinal axis
F filter
H1-H3 horizontal planes aligned parallel to the top surface ZD of the cylinder crankcase Z.
S flow direction of the melt
Z cylinder crankcase
ZD top surface of the cylinder crankcase Z
ZÖ cylinder openings
31 casting mould
32 cover core
33, 34 outer cores
35, 36 outer shell cores
37 core determining the inner contour of the casting ZK
38, 39 cores that determine the outer contour of the casting
40, 41 directed-away branches of the runner running on the outside
42 centrally arranged directed-back branch of the runner
43, 44 feeder pots
45, 46 external feed volumes
47, 48 feeds
ZK cylinder crankcase (casting)
M melt

The invention claimed is:

1. A casting mould for casting a complex-shaped casting from a molten metal, the casting mould comprising:

a mould cavity forming the casting; and a delivery system for delivery of the molten metal, which is to be cast into the casting, into the mould cavity, wherein the delivery system comprises a sprue, a runner connected to the sprue and a feeder system connected to the runner, and the mould cavity is connected to the feeder system and/or the runner via connections, wherein when seen in a flow direction of the molten metal flowing from the sprue into the runner during a casting operation, the runner has a directed-away branch directed away from the sprue along the feeder system and has a directed-back branch adjoining the directed-away branch, the directed-back branch guided along the feeder system in an opposite direction to the directed-away branch, and the feeder system is connected to both the directed-away branch and the directed-back branch via two or more gates distributed along a respective branch.

2. The casting mould according to claim 1, wherein a number of gates assigned to the directed-away branch is equal to a number of gates assigned to the directed-back branch.

3. The casting mould according to claim 1, wherein one of the gates, via which the directed-back branch is connected to the feeder system, is arranged opposite to a corresponding gate, via which the directed-away branch of the runner is connected to the feeder system.

4. The casting mould according to claim 1, wherein a size of the gates assigned to the directed-away branch is the same size as the gates assigned to the directed-back branch.

5. The casting mould according to claim 1, wherein the feeder system comprises at least one feeder chamber, which is connected via respectively at least one gate to both the directed-away branch and the directed-back branch of the runner.

6. The casting mould according to claim 5, wherein the feeder system comprises more than one feeder chamber, and the feeder chambers are connected to one another via a gate.

7. The casting mould according to claim 6, wherein the feeder system comprises at least two adjacent feeder chambers, and either the directed-away branch is arranged in an intermediate space between the feeder chambers and along a side of each of the feeder chambers runs a directed-back branch branching off from the directed-away branch, said side being outwardly disposed with respect to the intermediate space, or the runner is divided into two directed-away branches, one of which runs respectively along a side of the feeder chambers, said side being outwardly disposed with respect to the intermediate space, and at least one directed-back branch connected to the directed-away branches runs in an intermediate space between the feeder chambers.

8. The casting mould according to claim 7, wherein the runner is branched into two directed-away branches adjacent a connection to the sprue, and at least one directed-back branch is connected to the directed-away branches.

9. The casting mould according to claim 1, wherein the branches of the runner are arranged in a plane.

10. The casting mould according to claim 1, wherein the casting mould is composed as a core stack of a plurality of cores, of which certain cores form an outer shape and other cores form recesses, cavities, and/or channels in the casting to be produced.

11. The casting mould according to claim 10, wherein at least the casting cores surrounding the connections at least in sections are held in an outer shell of the casting mould.

12. The casting mould according to claim 11, wherein the outer shell is designed as a permanent mould part, which is preserved after demoulding the casting, and the casting cores, which are destroyed as lost casting mould parts during demoulding, are made of a moulding material based on casting sand.

13. The casting mould according to claim 1, wherein at least one connection leading from the feeder system and/or from the runner to the mould cavity is only guided outside of a volume of the casting mould occupied by the mould cavity.

14. The casting mould according to claim 13, wherein a plurality of connections, leading from the feeder system are provided, and inlet openings of the connections are arranged together in a plane.

15. The casting mould according to claim 1, wherein the directed-back branch has a first end connected to the directed-away branch and a second end connected only to the feeder system.

* * * * *